US010751721B2

(12) United States Patent
Hallberg et al.

(10) Patent No.: US 10,751,721 B2
(45) **Date of Patent: *Aug. 25, 2020**

(54) SPIDER ARM SHIELD

(71) Applicant: SANDVIK INTELLECTUAL PROPERTY AB, Sandviken (SE)

(72) Inventors: Anders Hallberg, Sodra Sandby (SE); Mikael M. Larsson, Eslov (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 413 days.

This patent is subject to a terminal disclaimer.

(21) Appl. No.: 15/517,929

(22) PCT Filed: Oct. 9, 2014

(86) PCT No.: PCT/EP2014/071656

§ 371 (c)(1),
(2) Date: Apr. 7, 2017

(87) PCT Pub. No.: WO2016/055112

PCT Pub. Date: Apr. 14, 2016

(65) Prior Publication Data

US 2017/0304832 A1 Oct. 26, 2017

(51) Int. Cl.

| | |
|---|---|
| ***B02C 2/06*** | (2006.01) |
| ***B02C 2/04*** | (2006.01) |
| *B02C 2/00* | (2006.01) |

(52) U.S. Cl.

CPC ..... *B02C 2/06* (2013.01); *B02C 2/042* (2013.01); *B02C 2/045* (2013.01); *B02C 2/00* (2013.01)

(58) Field of Classification Search

CPC ..... B02C 2/06; B02C 2/042; B02C 2/045; B02C 2/00

See application file for complete search history.

(56) References Cited

U.S. PATENT DOCUMENTS

| | | | | |
|---|---|---|---|---|
| 2,489,936 | A | 11/1949 | Shafter | |
| 2,832,547 | A | 4/1958 | Kennedy | |
| 3,026,051 | A | 3/1962 | Saari | |
| 8,070,084 | B2 * | 12/2011 | Biggin | B02C 2/06 241/209 |
| 9,358,545 | B2 * | 6/2016 | Bergman | B02C 2/06 |
| 9,592,512 | B2 * | 3/2017 | Andersson | B02C 2/06 |
| 9,643,187 | B2 * | 5/2017 | Christoffersson | B02C 2/04 |
| 9,827,569 | B2 * | 11/2017 | Aberg | B02C 2/06 |
| 10,046,329 | B2 * | 8/2018 | Andersson | B02C 2/04 |
| 2002/0088888 | A1 | 7/2002 | Van Mullem | |
| 2011/0192927 | A1 | 8/2011 | Biggin et al. | |
| 2015/0060584 | A1 * | 3/2015 | Aberg | B02C 2/06 241/209 |
| 2016/0016175 | A1 * | 1/2016 | Bergman | B02C 2/06 241/209 |

(Continued)

FOREIGN PATENT DOCUMENTS

| | | | |
|---|---|---|---|
| EP | 774683 | A1 | 9/2014 |
| WO | 2014125162 | A1 | 8/2014 |

*Primary Examiner* — Omar Flores Sanchez
(74) *Attorney, Agent, or Firm* — Corrine R. Gorski

(57) ABSTRACT

A gyratory crusher spider arm shield for releasable mounting to a spider arm is mounted in a position above and around the spider arm via locating feet and is maintained in the position by a fixating ring extending circumferentially around the spider arms and positioned at and above a perimeter of the spider.

14 Claims, 10 Drawing Sheets

(56) References Cited

U.S. PATENT DOCUMENTS

| | | | | |
|---|---|---|---|---|
| 2016/0067712 | A1* | 3/2016 | Christoffersson | B02C 2/04<br>241/207 |
| 2016/0250644 | A1* | 9/2016 | Andersson | B02C 2/06<br>241/209 |
| 2017/0304831 | A1* | 10/2017 | Hallberg | B02C 2/06 |

* cited by examiner

SPIDER ARM SHIELD

RELATED APPLICATION DATA

This application is a § 371 National Stage Application of PCT International Application No. PCT/EP2014/071656 filed Oct. 9, 2014.

FIELD OF INVENTION

The present invention relates to a gyratory crusher spider protection shield and in particular, although not exclusively, to a spider arm shield configured for mounting and dismounting at a spider arm so as to protect the arm from material to be crushed as it falls into the crushing zone.

BACKGROUND ART

Gyratory crushers are used for crushing ore, mineral and rock material to smaller sizes. Typically, the crusher comprises a crushing head mounted upon an elongate main shaft. A first crushing shell (referred to as a mantle) is mounted on the crushing head and a second crushing shell (referred to as a concave) is mounted on a frame such that the first and second shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber.

The main shaft is supported at its uppermost end by a top bearing housed within a central hub that forms a part of a spider assembly mounted on top of the topshell frame part. Spider arms project radially outward from the central hub to contact an outer rim at the top shell. The material to be crushed typically falls through the region between the spider arms and is prevented from causing damage to the arms by shields. Example shields are disclosed in U.S. Pat. Nos. 2,489,936; 2,832,547; 3,026,051; US 2002/0088888; US 2011/0192927. Such shields are typically secured to the spider arm via attachment bolts that project axially downward relative to the longitudinal axis of the main shaft. However, such configurations are disadvantageous as the bolt heads are exposed to the crushable material as it falls into the crushing chamber. With use, the bolt heads become damaged leading to attachment failure and subsequent loss of the shield that falls downwardly into the crushing chamber.

An alternative method of shield attachment involves welding the guards to the uppermost region of the spider arms. However, the welding process is both labour and time intensive and introduces additional problems when the worn shield needs removing. Additionally, the welding creates tension and stress concentrations into the spider arms.

Moreover, each of the spider arm shields is required to be raised independently for replacement or servicing. Accordingly, an auxiliary lifting crane is required to repeat lifting and lowering cycles to completely service the spider protection assembly. What is required is a spider protection shield that addresses the above problems.

SUMMARY OF THE INVENTION

It is an objective of the present invention to provide a modular spider protection shield for positioning over regions of the spider to protect it from crushable material falling into the crusher. It is a further specific objective to provide a shield or guard for a spider arm that may be conveniently attached to and dismounted from the spider without compromising the physical and mechanical integrity of the spider and in particular each spider arm. It is a further objective to minimise the time required to mount and dismount the spider shields at the spider by minimising the raising and lowering cycles of an auxiliary lifting crane.

It is a further specific objective to provide a spider shield that does not require welding the various regions of the spider or shield so as to secure the shield in position.

The objectives are achieved by providing a modular spider shield assembly and in particular a spider arm shield that is configured to be mounted on the spider and in particular the spider arm whilst being mechanically attachable to the spider via an intermediate positioned fixating ring that is in turn fixed to the spider. Accordingly, the present shield is not mechanically attached directly to the spider. This obviates the requirement for welding or bolting that is problematic when trying to detach the shield once worn and would also compromise the strength characteristics of the spider by creating stress concentrations resultant from welding or creating attachment boreholes in the spider.

By mounting the shields at a common fixating ring a plurality of the modular shields are connectable to form a unitary structure mounted above the spider that may be raised and lowered as a single unit with the spider by a single raising and lowering operation. Accordingly, the servicing and maintenance time required is significantly reduced relative to conventional arrangements.

Positioning the fixating ring at a perimeter of the spider is convenient so as to not obstruct the material flow path into the crusher and avoid or minimise wear of the fixating ring due to the falling material. The fixating ring may be conveniently attached via mounting bolts secured to an upper perimeter region of the spider that is typically used to mount a feed hopper. Accordingly, the present fixating ring comprises a lower annular flange for mounting to the spider and an upper annular flange for mounting to a feed hopper. Accordingly, the present fixating ring is configured to sit axially intermediate the spider and the hopper.

Advantageously, the present spider protection assembly may be assembled at the spider remote from the crusher and then lowered into position as a single unit for attachment onto the crusher. A worn shield of the assembly may then be independently removed from the crusher if prematurely worn or the entire spider and protection assembly may be removed via a single lifting operation with a replacement assembly lowered into position immediately afterwards to minimise the maintenance time required.

According to a first aspect of the present invention there is provided a gyratory crusher spider arm shield for releasable mounting to a spider arm that extends radially outward from a central hub and forms a part of a spider positioned on a top shell of a gyratory crusher, the shield comprising: a tunnel having a roof and sidewalls for positioning over and at least partially around the spider arm to protect an upper and side faces of the arm, the tunnel having a radially inner end for positioning at the hub and a radially outer end for positioning at a perimeter of the spider; a rear wall projecting upwardly from the radially outer end of the tunnel, the rear wall having an inner face orientated radially inwards towards the tunnel and an outer face orientated radially outward away from the tunnel, the rear wall representing a radially outermost part of the shield; characterised by: at least one attachment element provided at the rear wall to attach the shield to a fixating ring via the outer face, the fixating ring positionable on top of and at the perimeter of the spider to surround at least part of the spider and the arm shield.

Preferably, the shield further comprises at least one locating foot projecting downwardly from a lower portion of the rear wall radially behind the tunnel. The foot is configured to contact the upper perimeter region of the spider and provide a secure mounting of the shield onto the spider. The foot also facilitates correct alignment by guiding the shield into position when lowered by the lifting crane. Preferably, the shield further comprises at least one locating foot projecting downwardly from the roof of the tunnel for contacting the upper face of the arm. Accordingly, the shield is balanced securely onto the spider arm at both the radially inner and radially outer the ends via the radially inner and outer locating feet. The feet simply abut against the upper region of the arm and spider and do not require mechanical fixation that would be otherwise be problematic to remove or introduce stress concentrations to the arm or main body of the spider. Preferably, the shield comprises two radially outer feet extending downwardly from the rear wall and two radially inner feet extending downwardly from the tunnel roof to contact the upper face of the arm at a radially inner position.

Preferably, the rear wall comprises a length being aligned generally transverse to the radially extending tunnel, the length of the rear wall being curved corresponding to an arc of a circle. Preferably, the rear wall comprises a curvature corresponding approximately to the curvature of the cylindrical hopper wall and the annular rim of the spider on which the fixating ring is positioned and secured.

Preferably, the shield further comprises a skirt extending laterally outward in a sideways direction from the sidewalls at the radially outer end of the tunnel for positioning over a radially inner face of the spider either side of the spider arm. The skirt is configured to protect the radially inner face of the spider either side of the spider arm. Preferably, the tunnel, the skirt and the rear wall are formed integrally as a single body. This is advantageous to provide a robust construction to withstand the significant loading and impact forces encountered by the shield during use. According to preferred implementations, the skirt and the tunnel are devoid of notches projecting inwardly from an edge of the skirt or tunnel or holes provided in the skirt and tunnel that would otherwise introduce stress concentrations.

Preferably, the attachment element comprises a hole. Preferably, the shield comprises two holes, each hole positioned respectively towards or at each lengthwise end of the rear wall. The holes are configured to receive shafts of anchorage bolts extending through the rear wall and corresponding holes provided at the fixating rings. Alternatively, the fixating ring may comprise projections, pins, lugs, bayonet fittings and the like to engage the holes of the rear wall to allow releasable attachment. As will be appreciated, the mechanism for releasable attachment at the shield at the fixating ring may comprise any form of mechanical attachment found in the art. Optionally, the shield may be releasably clipped onto the fixating ring or may be secured via resiliently biased members that may extend radially to interengage and provide a bridging connection between the fixating ring and the shield.

Preferably, the side walls of the tunnel are curved in a direction from the inner end to the outer end so as to flare laterally outwardly in a circumferential direction away from the tunnel at the outer end. Such a configuration is beneficial to prevent shelf building or bridging of the crushable material falling downwardly onto the shield. The material is accordingly configured to slide over the shield and down into to the crushing chamber. The curvature of the shield extends in both the radial and axial directions so as to provide a generally rounded and curved shaped configuration to facilitate the material sliding axially downward over the shield.

The shield further comprises a radially extending ridge projecting upwardly along the length of the tunnel and having an aperture, notch or hooked member to enable the shield to be connected to a lifting device. An axial depth of the ridge (i.e. a distance by which the ridge extends axially upward from the tunnel increases from the radially inner to radially outer end of the tunnel. Preferably, the ridge extends from the radially innermost end of the tunnel and terminates at the radially inner face of the rear wall. Preferably, the lifting aperture is positioned at a region along the radial length of the shield between its radially inner and outer ends at the mass centre of the shield to allow the shield to be raised and lowered in a generally horizontal orientation to facilitate seating onto the spider when lowered into position.

According to a second aspect of the present invention there is provided a gyratory crusher spider protection assembly comprising: a plurality of arm shields as claimed herein mountable over each of a plurality the spider arms or a spider; a fixating ring positionable on top of and at the perimeter of the spider to extend circumferentially around at least part of the spider and the arm shields; and a plurality of fixation elements securable respectively to each of the attachment elements to releasably fix the shields to the fixating ring such that the arm shields and fixating ring are configured to form a unitary assembly.

Preferably, the assembly further comprises anchorage elements to secure the fixating ring to an upper region of the spider at the perimeter of the spider. The anchorage elements are preferably bolts extending axially between the fixating ring and the perimeter region of the spider. Preferably, the fixating ring comprises a lower annular flange for positioning on top of and in contact with an annual flange of the spider and an upper annular flange for contacting and supporting a material feed hopper. Preferably, both upper and lower annular flanges comprise circumferentially spaced boreholes to receive attachment bolts extending through both upper and lower flanges and into secure engagement with the axially lower spider and axially upper hopper.

Preferably, the assembly further comprises a plurality of spider wall shields mountable circumferentially between the arm shields, each of the wall shields comprising a rear wall extending upwardly from and projecting transverse to a spider protection wall positionable over a radially inward facing face of the spider, the rear wall having an inner face orientated radially inwards and an outer face orientated radially outward, the rear wall representing a radially outermost part of the wall shield; and a plurality of attachment elements provided at the rear wall to attach the wall shields to the fixating ring via the outer face such that the arm shields, the wall shields and fixating ring are configured to form a unitary assembly. The wall shield are configured to sit circumferentially intermediate the arm shields so as to form a generally annular and modular spider protection assembly covering the spider arms and radially inner face of the spider. Each of the arm and wall shields are removably mounted at the common fixating ring such that when attached the assembly is formed as a single unitary body that may be conveniently raised and lowered into position with the spider via a single lifting and lowering operation.

According to a third aspect of the present invention there is provided a gyratory crusher comprising: a spider having: a central hub; and a plurality of spider arms extending radially outward from the hub towards an outer perimeter of the spider; a material feed hopper mounted axially above the spider; and a spider protection assembly as claimed herein; wherein the fixating ring is positioned axially intermediate the spider and the hopper.

The present crusher and spider protection assembly is advantageous via its mechanism of attachment of each individual shield to the fixating ring. Accordingly, the crusher is devoid of any welding to otherwise secure the arm and wall shields to the respective spider arms and the inward facing face of the spider such that the arm and wall shields are secured exclusively to the spider via the fixating ring.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
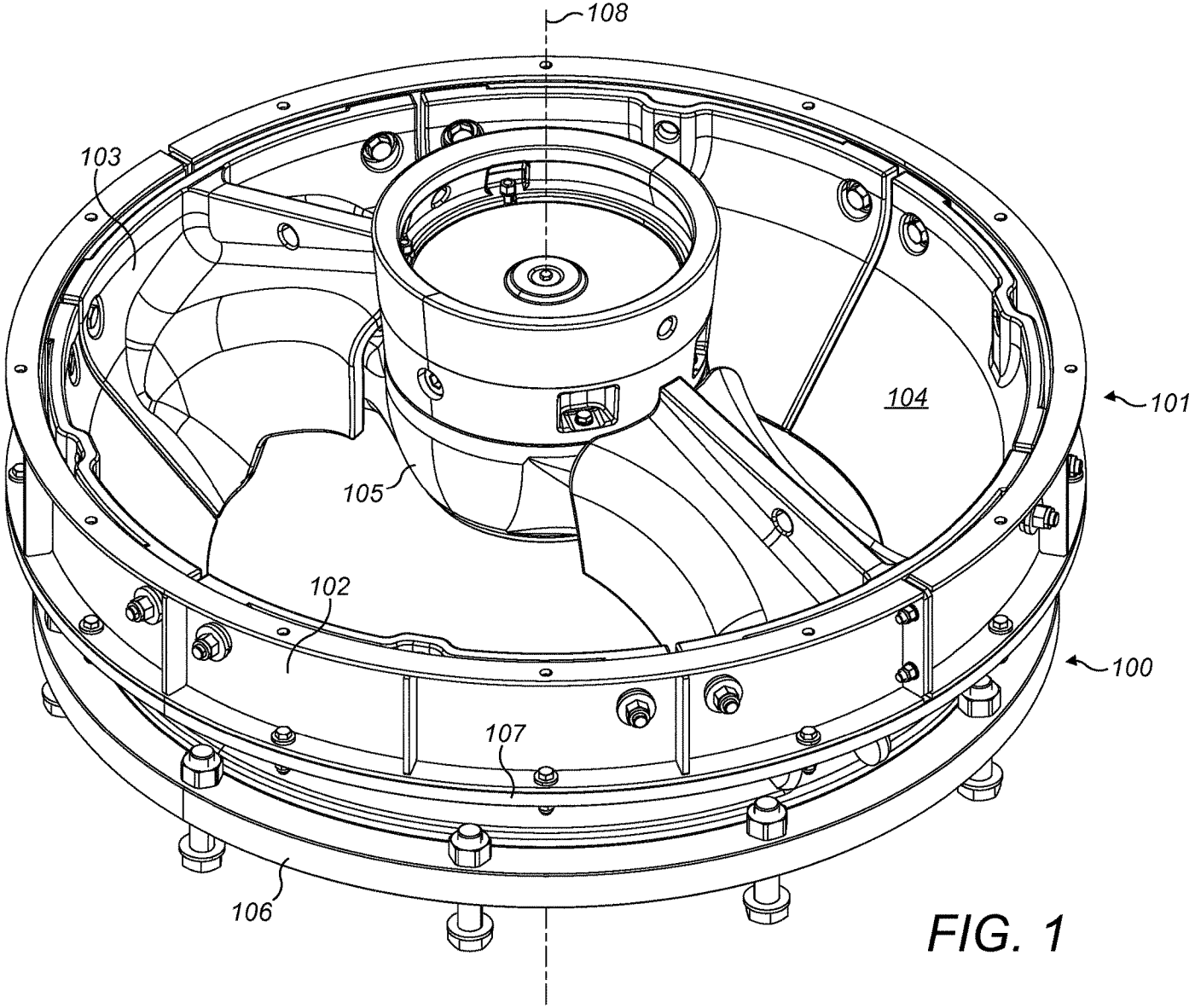
FIG. 1 is an upper external perspective view of a gyratory crusher spider protection assembly mounted in position over a spider according to a specific implementation of the present invention.
Figure 2:
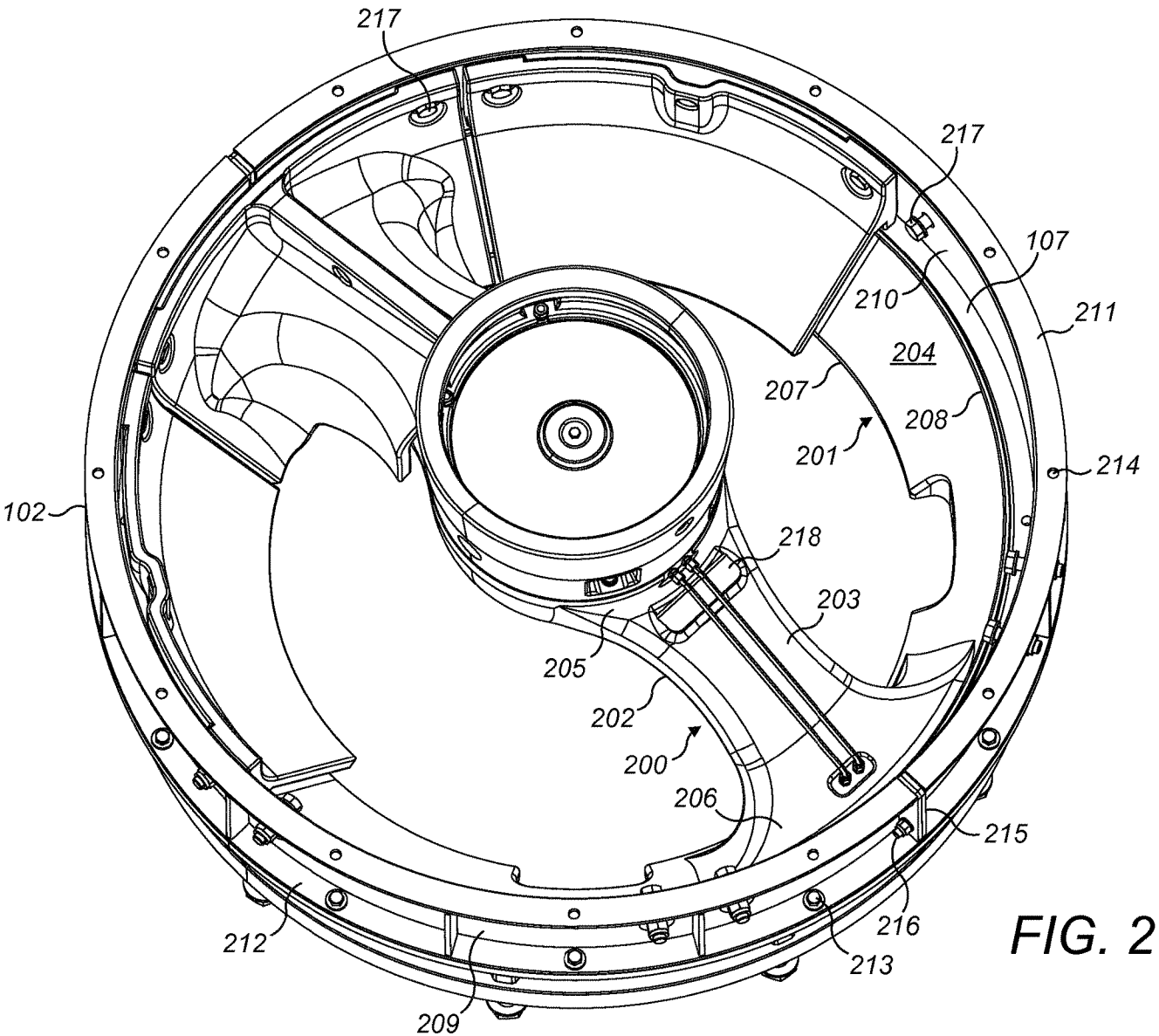
FIG. 2 is a further perspective view of the spider protection assembly of FIG. 1 mounted on the spider with selected components of the protection assembly removed for illustrative purposes.

Referring to FIGS. 1 and 2, a spider of a gyratory crusher is indicated generally by reference 100 and comprises a pair of diametrically opposed arms 200. Arms 200 extend radially outward from a central boss 105 centred on a longitudinal axis 108 extending through spider 100 and a gyratory crusher (not shown) mounted generally axially below spider 100. Each arm 200 comprises a radially innermost region 205 positioned at boss 105 and a radially outermost region 206 positioned at a spider wall indicated generally by reference 201. Each arm 200 therefore represents a bridge extending between boss 105 and an annular spider perimeter wall 201. Each arm 200 comprises a side face 202 an upper face 203 and an underside face (not shown) extending between radially inner and outer regions 205, 206.

Spider wall 201 is orientated to be angled or declined relative to longitudinal axis 108 such that an axially lowermost edge 207 is positioned closer to axis 108 than an axially upper annular edge/region 208. A radially inward facing surface 204 of spider wall 201 is orientated towards central boss 105 and extends circumferentially between spider arms 200.

Referring to FIGS. 1 to 4, the present spider protection assembly comprises a plurality of individual protection shields collectively secured to a common fixating ring that surrounds circumferentially each of the shields. In particular, protection assembly is indicated generally by reference 101 and comprises annular fixating ring 102, a plurality of spider wall shields 104 and a plurality of spider arm shields 103. Fixating ring 102 according to the specific implementation, is formed by two semi-cylindrical halves that are secured together via their respective circumferential ends 215 by attachment bolts 216 to form an annular structure. An axially upper attachment rim 211 projects radially outward from an axially upper region of ring 102 and a corresponding axially lower rim 212 projects radially outward from an axially lower region of ring 102. Lower rim 212 is configured for positioning to sit on top of an axially upper rim 107 of spider 100 with a lower spider rim 106 configured for mounting on top of a lower shell of the gyratory crusher (not shown). Fixating ring 102 is secured to the spider rim 107 via attachment bolts 213. Additionally, upper fixating rim 211 provides a mounting flange to support a material feed hopper (not shown) secured to rim 211 via corresponding attachment bolts 213 received through holes 214 distributed circumferentially around each rim 211, 212. Accordingly, fixating ring 102 is configured to sit axially between the uppermost material feed hopper (not shown) and spider 100. Ring 102 comprises a generally radially outward facing surface 209 and a corresponding radially inward facing surface 210. Each of the spider shields 103, 104 is secured to ring 102 via contact with the ring inward facing surface 210 and respective attachment bolts 217 that project radially through ring 102 and each shield 103, 104. Accordingly, shields 103, 104 are demountably secured to shield 103 so as to extend and project radially inward from the ring inward facing surface 210.

Figure 3:
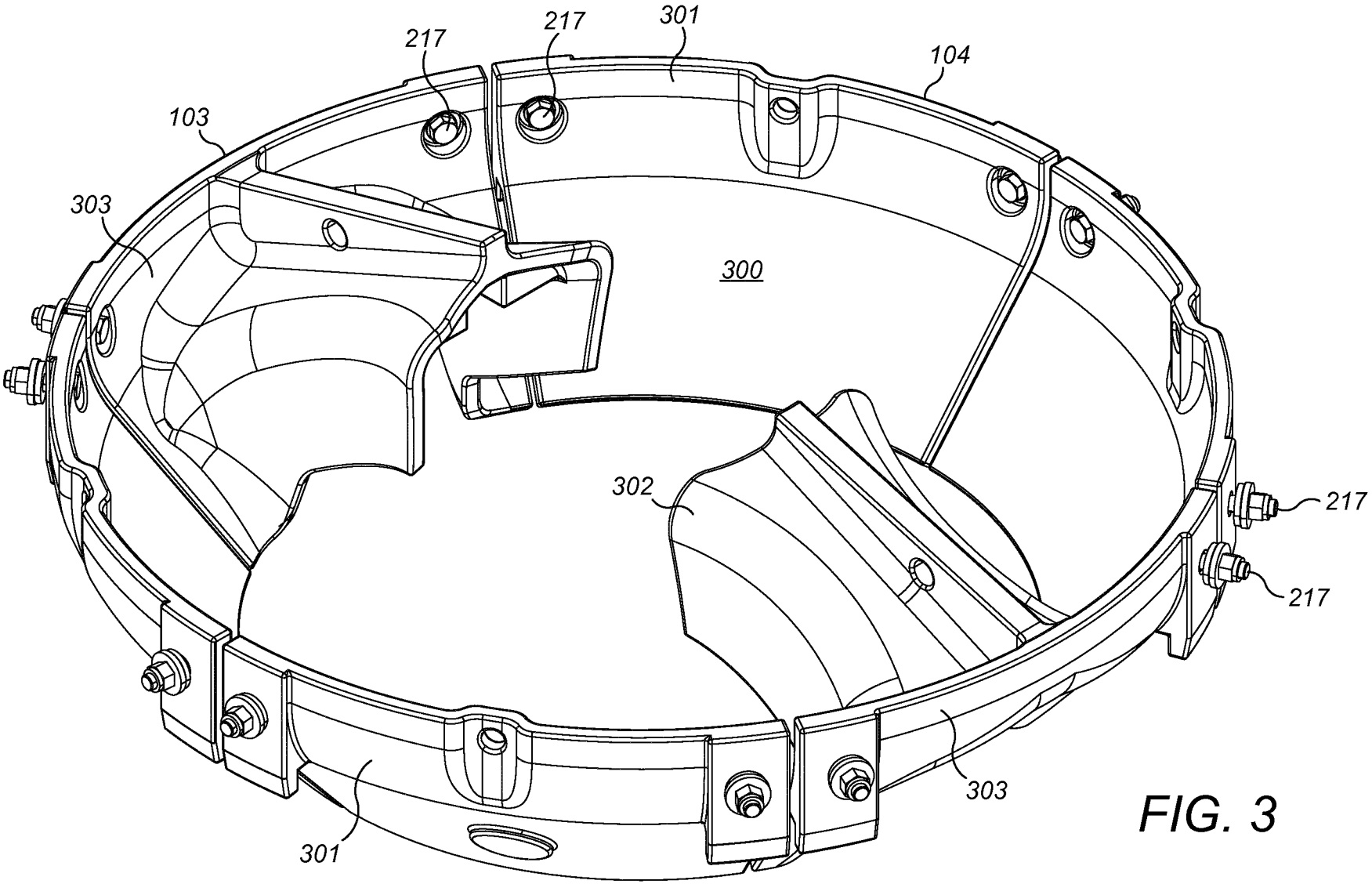
FIG. 3 is a perspective view of the protection assembly isolated from the spider according to a specific implementation of the present invention.
Figure 4:
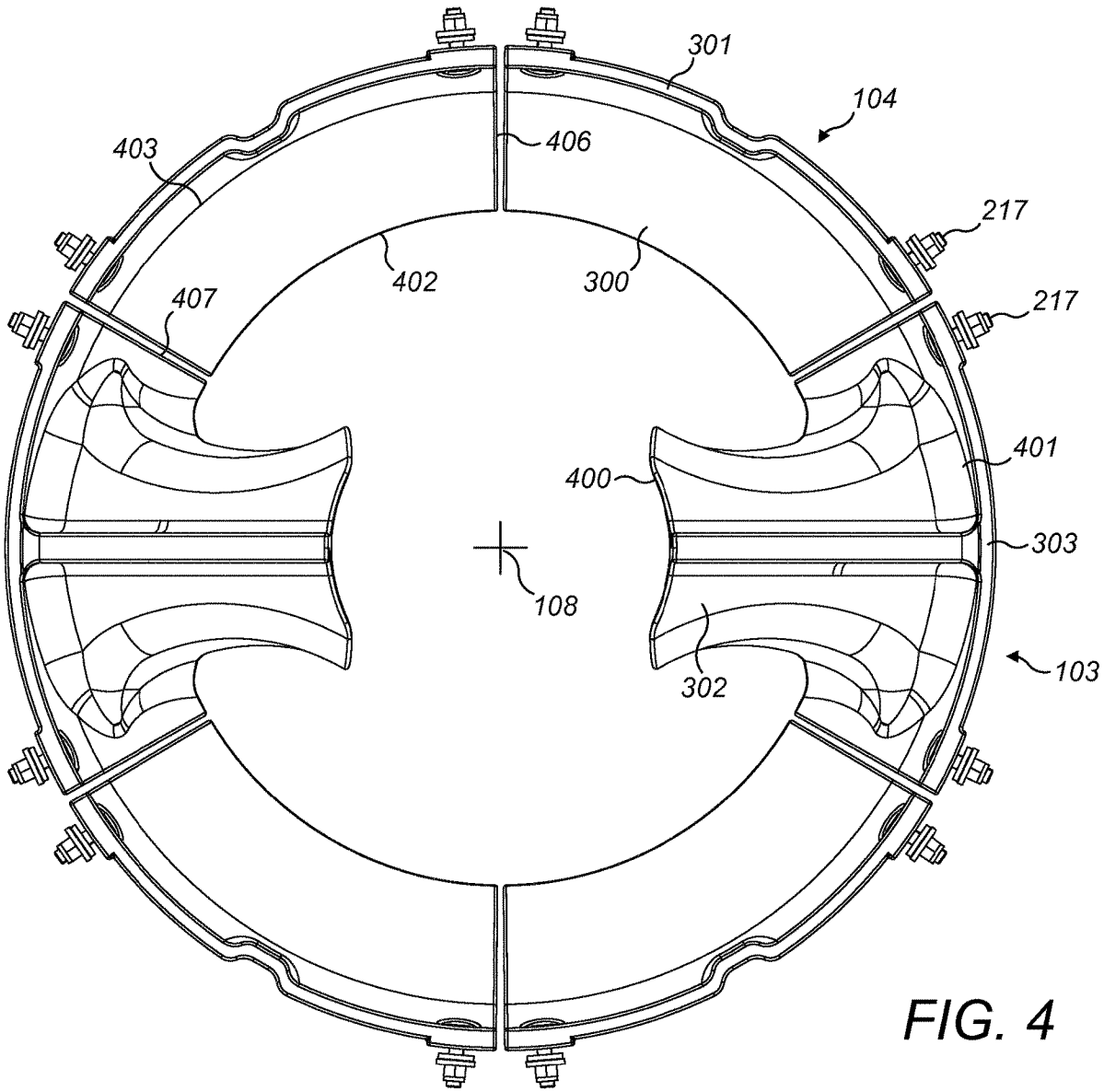
FIG. 4 is a plan view of the protection assembly of FIG. 3.

Referring to FIGS. 3 and 4, the spider protection assembly 101 may be considered to comprise a generally annular configuration being formed from four individual spider wall shields 104 and two diametrically opposed spider arm shields 103. The wall shields 104 are arranged in pairs such that the arm shields 103 are positioned circumferentially between each pair of wall shields 104. Each wall shield 104 comprises a spider protection wall 300 that is orientated to be declined relative to axis 108 and to slope downwardly relative to a rear wall indicated generally by reference 301 where the rear wall 301 represents an axially uppermost part of wall shield 104. Additionally, each arm shield 103 comprises a radially extending tunnel indicated generally by reference 302 that projects radially inward from a rear wall indicated generally by reference 303. Tunnel 302 comprises a radially innermost end 400 and a radially outermost end 401 positioned at rear wall 303. Tunnel inner end 400 is configured for positioning over the radially inner part 205 of spider arm 200 whilst tunnel outer end 401 is configured for positioning over spider arm outer region 206. Similarly, wall 300 of shield 104 is configured for positioning over spider wall 201 such that wall lowermost edge 402 is configured for positioning at the lowermost edge 207 of spider wall 201 whilst an upper region 403 of shield wall 300 is configured for positioning at the upper edge 208 of spider wall 201.

As illustrated in FIG. 4, each wall shield 104 comprises a pair of lengthwise end edges 406 and each arm shield 103 comprises a corresponding pair of lengthwise end edges 407 such that edges 406, 407 are configured to be positioned in near touching contact and opposed to one another to form the generally annular protection assembly 101.

Figure 5:
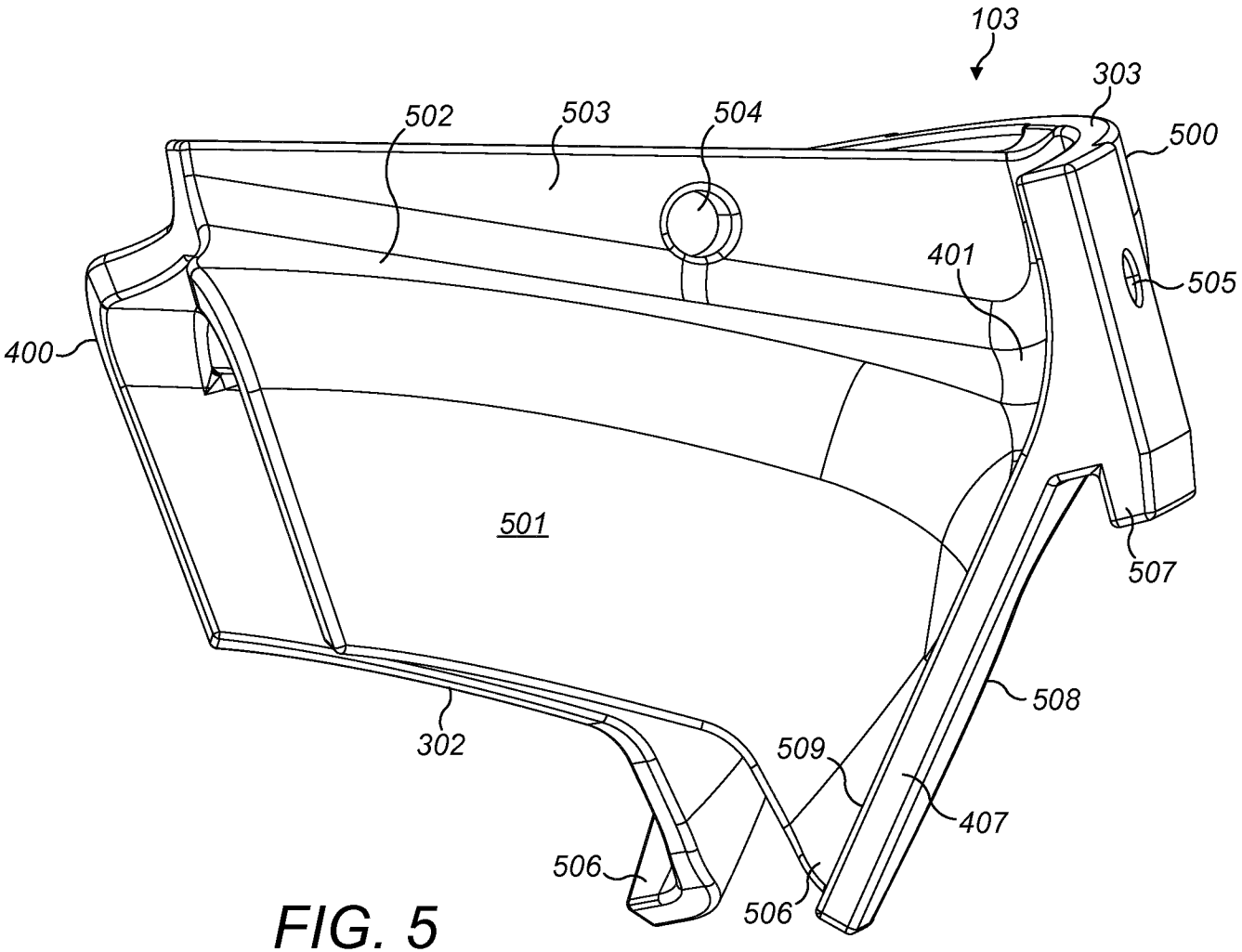
FIG. 5 is a side perspective view of a component of the protection assembly of FIG. 4 intended for positioning over a spider arm according to a specific implementation of the present invention.
Figure 6:
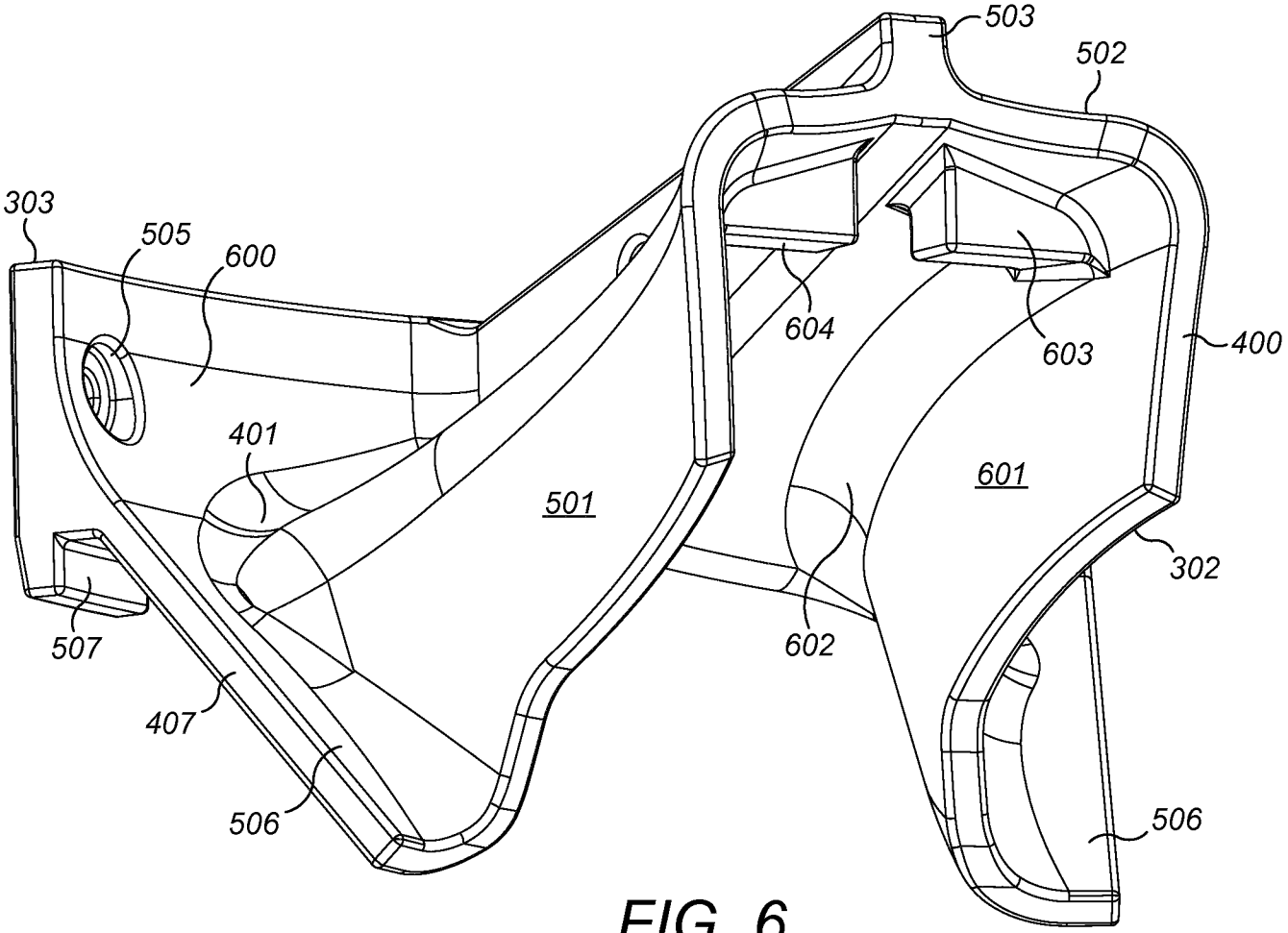
FIG. 6 is an underside perspective view of the spider arm shield of FIG. 5.
Figure 7:
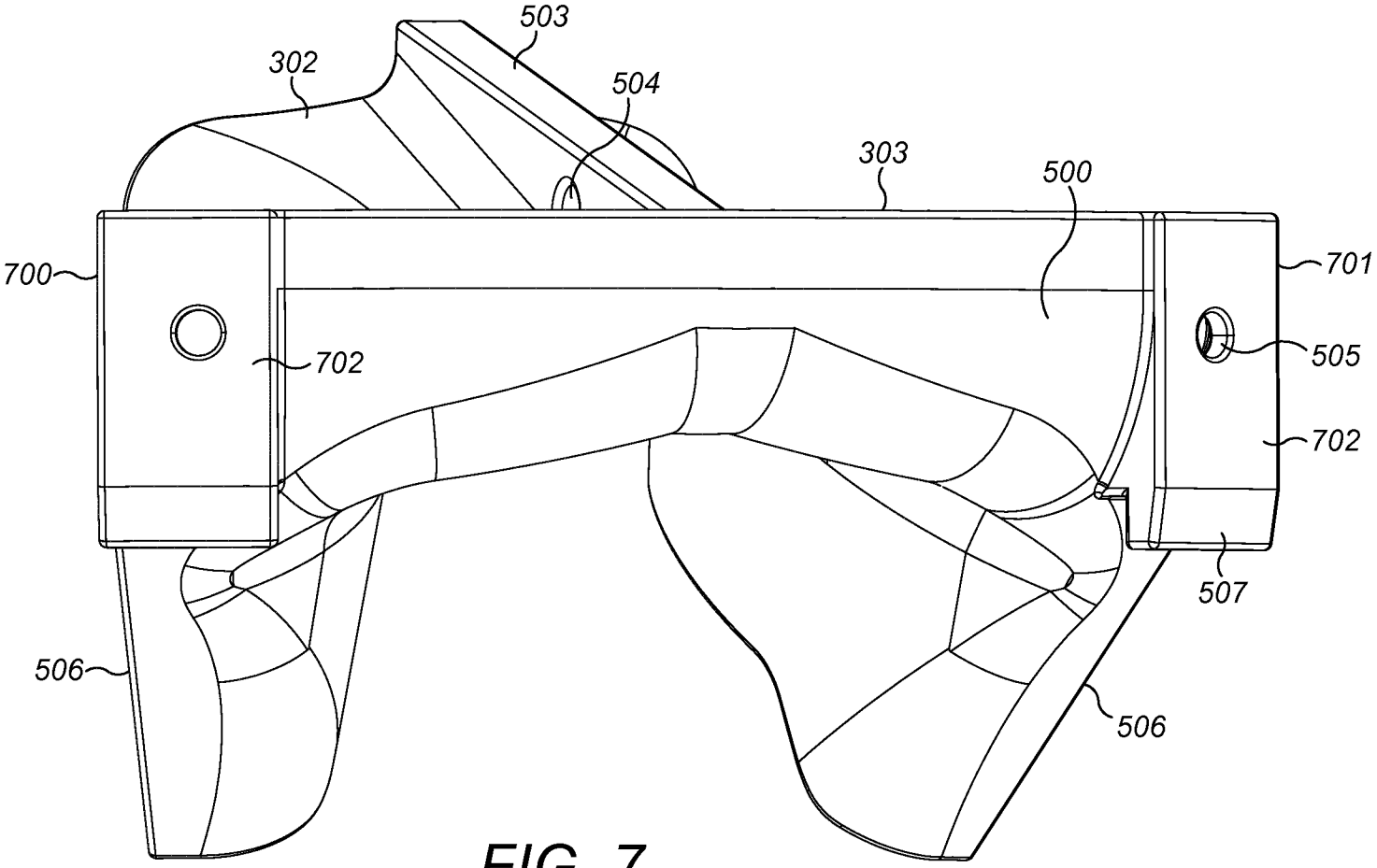
FIG. 7 is a rear perspective view of the arm shield of FIG. 6.

Referring to FIGS. 5 to 7 each arm shield tunnel 302 comprises side walls 501 projecting axially downward from a roof 502. Accordingly, inner surface 601 of side walls 501 is configured for positioning against the spider arm side faces 202 whilst an inner roof surface 602 is configured for positioning opposed to spider arm upper face 203. A pair of locating feet 603 project axially downward from roof surface 602 and comprise lowermost abutment faces 604 to contact a raised flange 218 projecting radially upward from spider arm upper face 203 at radially inner end 205. The locating feet 603 are spaced apart in a circumferential direction relative to axis 108. A ridge 503 projects axially upward from roof 502 and extends the radial length of tunnel 302 between radially inner and outer ends 400, 401. An aperture 504 is provided through ridge 503 to allow shield 103 to be attached to a lifting crane to raise and lower shield 103 relative to spider 100. Aperture 504 is positioned at the approximate mass centre of shield 103 between tunnel inner end 400 and rear wall 303 such that shield 103 is configured to be suspended in the orientation of FIG. 5 aligned with the orientation of spider arm 200.

Tunnel 302 is generally curved along its length between ends 400, 401 (in a radial direction) such that tunnel 302 flares circumferentially outward at radially outer end 401. Accordingly, tunnel 302 at end 401 is curved so as to terminate at a skirt 506 that is aligned generally transverse (including perpendicular) to the main length of tunnel 302. Accordingly, skirt 506 is curved to extend in a general circumferential direction of spider wall 201 so as to sit opposed and to spider wall 201 circumferentially either side of spider arm 200. Skirt 506 represents the circumferential ends of arm shield 103 comprising edges 407. Edges 407 are aligned to be declined relative to axis 108 at the same angled orientation as spider walls 201. Accordingly, tunnel 302 at the radially outermost end 401 projects axially downward and circumferentially outward to form skirt 506. An axially lower region of skirt 506 is configured to be positioned at the lower annular edge 207 of spider wall 201. An axially upper region of skirt 506 and the radially outer end 401 of tunnel 302 terminates at shield rear wall 303. Wall 303 is generally curved in the axial direction so as to provide a smooth transition into tunnel 302 and skirt 506. Skirt 506 comprises a radially inward facing surface 509 and a radially outward facing surface 508 with surface 508 configured for positioning in contact with spider wall surface 204. Additionally, rear wall 303 is curved in a circumferential direction to correspond to the curvature of the inner surface 210 of fixating ring 102. Rear wall 303 comprises a radially inward facing surface 600, a radially outward facing surface 500 and an attachment flange 702 that projects radially outward from wall outer surface 500 at each lengthwise end 700, 701 of rear wall 303. Each flange 702 is terminated at its axially lowermost end by an anchorage foot 507. Foot 507 represents an axially extending abutment projecting downwardly from rear wall 303 to be positioned radially outside skirt 506 and tunnel 302. Each foot 507 is configured to locate onto the upper annular rim 107 of spider 100. Accordingly, arm shield 103 is configured to seat onto spider 100 via contact with feet 603 locating onto flange 218 and feet 507 locating onto rim 107. A rear surface of each flange 702 is configured to extend generally parallel to axis 108 and in close touching contact with the radially inward facing surface 210 of fixating ring 102. An aperture 505 extends through rear wall 303 and in particular each attachment flange 702 to receive attachment bolt 217 to releasably secure shield 103 to fixating ring 102 surface 210. Accordingly, the pair of arm shields 103 and the fixating ring 102 are configured to form a unitary structure that may be raised and lowered as a single modular body to and from spider 100.

Figure 8:
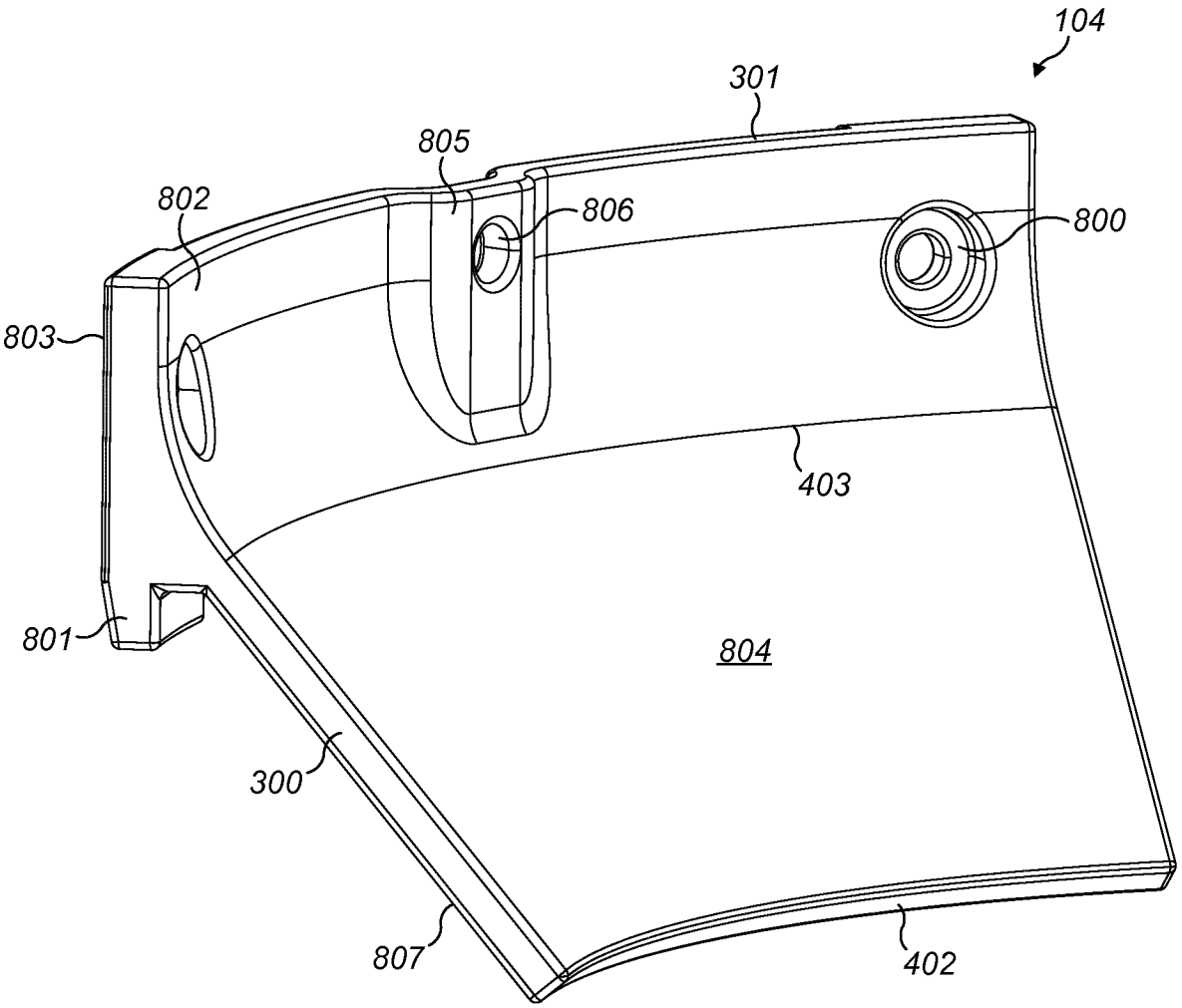
FIG. 8 is a perspective view of a spider wall shield for positioning over the inward facing surface of a spider and forming a part of the spider protection assembly of FIG. 4 according to a specific implementation of the present invention.
Figure 9:
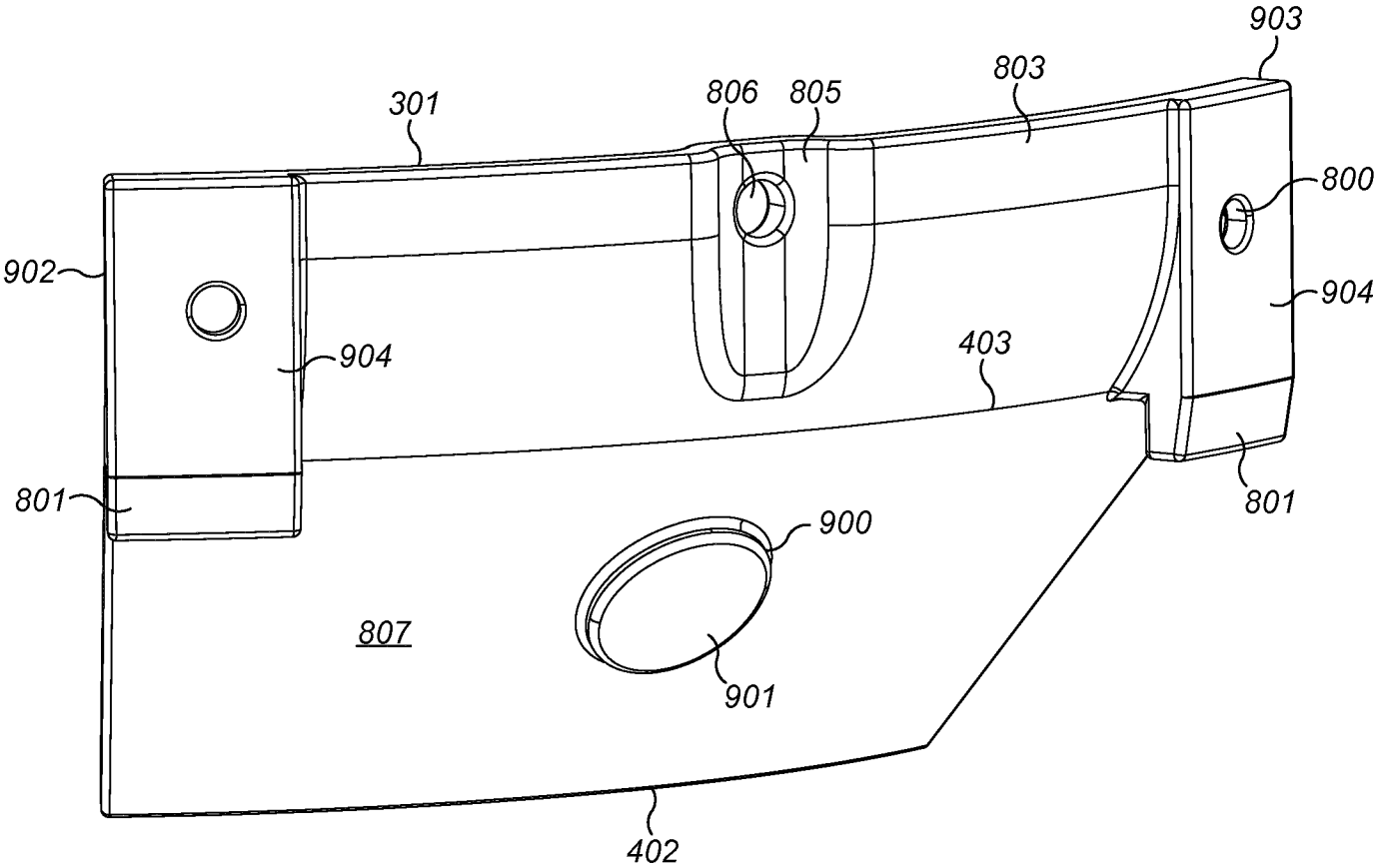
FIG. 9 is a rear perspective view of the spider wall shield of FIG. 8.
Figure 10:
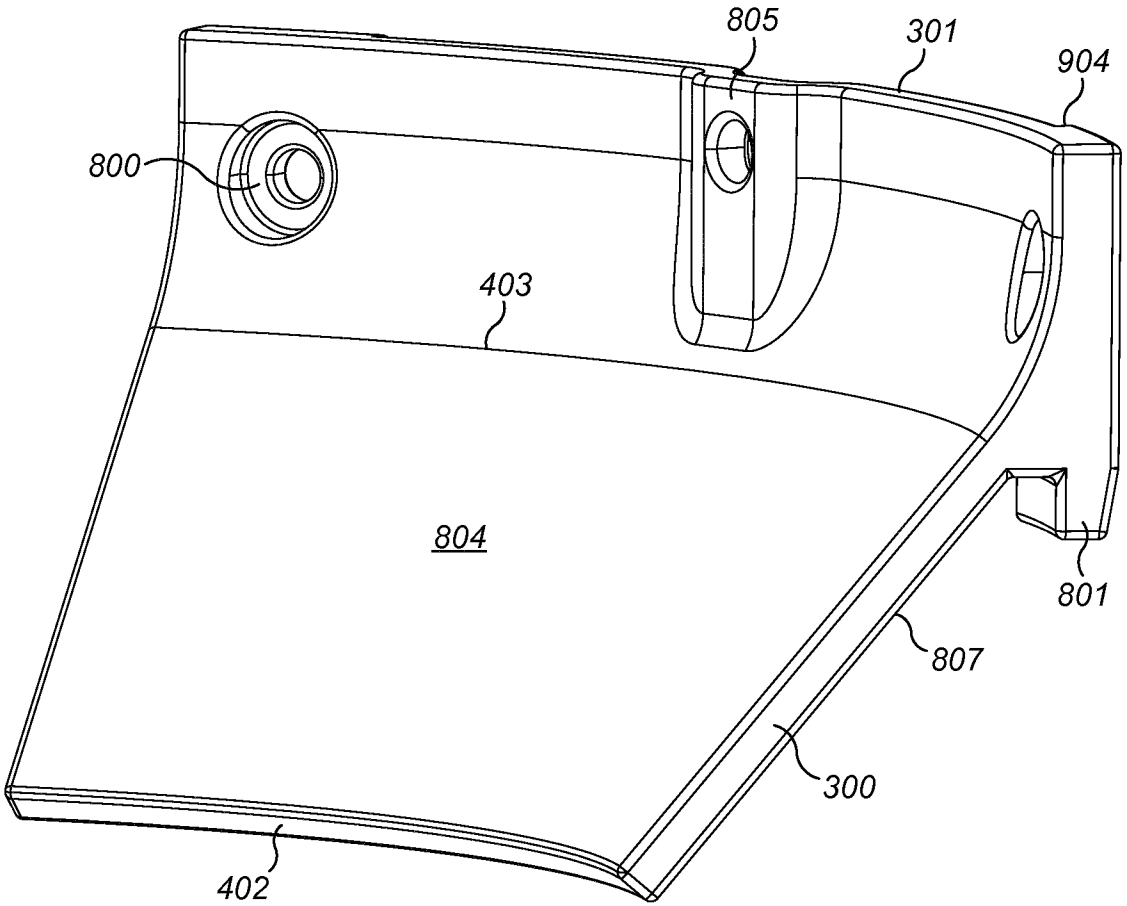
FIG. 10 is a further perspective view of the spider wall shield of FIG. 9.

Referring to FIGS. 8 to 10, shield protection wall 300 comprises a radially inward facing surface 804 and a radially outward facing surface 807. Surface 807 is configured for positioning opposed to spider wall surface 204. Accordingly, shield protection wall 300 is curved in a circumferential direction between circumferential ends 406. Wall 300 is orientated to extend at a transverse angle to a generally upright rear wall 301 that comprises a section that is aligned parallel to axis 108. To provide an appropriately contoured material contact surface (to facilitate the axially downward flow of material into the crusher), wall surface 804 and a radially inward facing surface 802 of rear wall 301 represents a single seamless inward facing surface. That is, the junction region 403 in the axial direction between rear wall 301 and protection wall 300 is curved. Rear wall 301 comprises a radially outward facing surface 803 having a length extending between first and second ends 902, 903. Rear wall 301 is curved along its length between ends 902, 903 so as to be arcuate and having a curvature corresponding to the curvature of fixating ring 102 and spider upper rim 107. A respective attachment flange 904 projects radially outward from rear wall 301 at each lengthwise end 902, 903. Each flange 904 is terminated at its axially lowermost end by a locating foot 801. Each foot 801 projects axially downward to the rear of the generally declined protection wall. A rear surface of each flange 904 is configured to extend generally parallel to axis 108 and in close touching contact with the radially inward facing surface 210 of fixating ring 102. An aperture 800 extends radially through rear wall 301 and each flange 904 to receive respective attachment bolts 217 to secure shield 104 to the inward facing surface 210 of fixating ring 102.

A locating foot 900 projects radially outward from the radially outward facing (underside) surface 807 of protection wall 300. Foot 900 is generally disc shaped having a circular downward facing surface 901 configured to locate in touching contact against the spider wall surface 204. Foot 900 is positioned at a central location within wall 300 axially intermediate lower edge 402 and upper region 403. Accordingly, shield 104 is configured to be self-supporting on spider 100 via contact between feet 801 at spider rim 107 and foot 900 at spider wall 201.

Each shield rear wall 301 comprises a mid-region 805 that is curved radially inward to form a pocket at the region radially between outward facing surface 803 of wall 301 and the radially inward facing surface 210 of ring 102. An aperture 806 extends through region 805 to provide a means of attaching a lifting device (not shown) to shield 104. Each shield 104 is secured in position via releasable attachment to fixating ring 102 using attachment bots 217 inserted through apertures 800. Accordingly, the ring 102 and the four spider wall shield 104 are connectable to form a unitary body that may be collectively raised and lowered with the spider 100 relative to the crusher (not shown).

The invention claimed is:

1. A gyratory crusher spider arm shield arranged to be releasably mounted to a spider arm that extends radially outward from a central hub and forms a part of a spider positioned on a top shell of a gyratory crusher, the arm shield comprising:

a tunnel having a roof and sidewalls arranged to be positioned over and at least partially around the spider arm to protect an upper and side faces of the arm, the tunnel having a radially inner end arranged to be positioned at the hub and a radially outer end arranged to be positioned at a perimeter of the spider;

a rear wall projecting upwardly from the radially outer end of the tunnel, the rear wall having an inner face orientated radially inwards towards the tunnel and an outer face orientated radially outward away from the tunnel, the rear wall representing a radially outermost part of the shield;

at least one attachment element provided at the rear wall arranged to attach the shield to a fixating ring via the outer face, the fixating ring being positionable on top of and at the perimeter of the spider to surround at least part of the spider and the arm shield; and at least one locating foot projecting downwardly from a lower portion of the rear wall to extend downwardly and radially behind the tunnel.

2. The shield as claimed in any claim 1, further comprising at least one locating foot projecting downwardly from the roof of the tunnel for contacting the upper face of the arm.

3. The shield as claimed in any claim 1, wherein the rear wall includes a length being aligned generally transverse to the radially extending tunnel, the length of the rear wall being curved corresponding to an arc of a circle.

4. The shield as claimed in claim 1, further comprising a skirt extending laterally outward in a sideways direction from the sidewalls at the radially outer end of the tunnel for positioning over a radially inner face of the spider at either side of the spider arm.

5. The shield as claimed in claim 4, wherein the attachment element includes a hole.

6. The shield as claimed in claim 5, further comprising two holes, each hole positioned respectively towards or at each end of the length of the rear wall.

7. The shield as claimed in claim 6, wherein the tunnel, the skirt and the rear wall are formed integrally.

8. The shield as claimed in any claim 1, wherein the sidewalls of the tunnel are curved in a direction from the inner end to the outer end to flare laterally outwardly in a circumferential direction away from the tunnel at the outer end.

9. The shield as claimed in any claim 1, further comprising a radially extending ridge projecting upwardly along the length of the tunnel and having an aperture, notch or hooked member to enable the shield to be connected to a lifting device.

10. A gyratory crusher spider protection assembly comprising:

a plurality of arm shields arranged to be releasably mounted over each of a plurality the spider arms that extend radially outward from a central hub or a spider positioned on a top shell of a gyratory crusher, each arm shield including a tunnel having a roof and sidewalls arranged to be positioned over and at least partially around a spider arm to protect an upper and side faces of the arm, the tunnel having a radially inner end arranged to be positioned at the hub and a radially outer end arranged to be positioned at a perimeter of the spider, an arm shield rear wall projecting upwardly from the radially outer end of the tunnel, the arm shield rear wall having an inner face orientated radially inwards towards the tunnel and an outer face orientated radially outward away from the tunnel, the arm shield rear wall representing a radially outermost part of the arm shield, and at least one locating foot projecting downwardly from a lower portion of the rear wall to extend downwardly and radially behind the tunnel;

a fixating ring arranged to be positioned on top of and at the perimeter of the spider to extend circumferentially around at least part of the spider and the arm shields, wherein each arm shield includes at least one attachment element provided at the rear wall arranged to attach the shield to a fixating ring via the outer face; and a plurality of fixation elements securable respectively to each of the attachment elements to releasably fix the arm shields to the fixating ring such that the arm shields and fixating ring are configured to form a unitary assembly.

11. The assembly as claimed in claim 10, further comprising anchorage elements to secure the fixating ring to an upper region of the spider at the perimeter of the spider.

12. The assembly as claimed in claim 10, further comprising a plurality of spider wall shields mountable circumferentially between the arm shields, each of the wall shields including a wall shield rear wall extending upwardly from and projecting transverse to a spider protection wall positionable over a radially inward facing face of the spider, the wall shield rear wall having an inner face orientated radially inwards and an outer face orientated radially outward, the wall shield rear wall representing a radially outermost part of the wall shield, and a plurality of attachment elements provided at the wall shield rear wall to attach the wall shields to the fixating ring via the outer face such that the arm shields, the wall shields and the fixating ring are configured to form a unitary assembly.

13. A gyratory crusher comprising:

a spider having a central hub and a plurality of spider arms extending radially outward from the hub towards an outer perimeter of the spider;

a material feed hopper mounted axially above the spider; and a spider protection assembly including a plurality of arm shields arranged to be releasably mounted over the plurality the spider arms, each arm shield including a tunnel having a roof and sidewalls arranged to be positioned over and at least partially around a spider arm to protect upper and side faces of the arm, the tunnel having a radially inner end arranged to be positioned at the hub and a radially outer end arranged to be positioned at a perimeter of the spider, a rear wall projecting upwardly from the radially outer end of the tunnel, the rear wall having an inner face orientated radially inwards towards the tunnel and an outer face orientated radially outward away from the tunnel, the rear wall representing a radially outermost part of the arm shield, and at least one locating foot projecting downwardly from a lower portion of the rear wall to extend downwardly and radially behind the tunnel;

a fixating ring arranged to be positioned on top of and at the perimeter of the spider to extend circumferentially around at least part of the spider and the arm shields, wherein plurality of arm shield include attachment elements provided at the rear wall; and a plurality of fixation elements securable respectively to each of the attachment elements to releasably fix the arm shields to the fixating ring such that the arm shields and fixating ring are configured to form a unitary assembly, wherein the fixating ring is positioned axially intermediate the spider and the hopper.

14. The crusher as claimed in claim 13, wherein the crusher is devoid of any welding to otherwise secure the arm and wall shields to the respective spider arms and the inward facing face of the spider such that the arm and wall shields are secured exclusively to the spider via the fixating ring.

* * * * *